US006118266A

United States Patent [19]

Manohar et al.

[11] Patent Number: 6,118,266

[45] **Date of Patent: *Sep. 12, 2000**

[54] LOW VOLTAGE REFERENCE WITH POWER SUPPLY REJECTION RATIO

[75] Inventors: Amar S. Manohar; Bor Lee, both of San Jose; Vincent Condito, Palo Alto, all of Calif.

[73] Assignee: Mars Technology, Inc., San Jose, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/393,238

[22] Filed: Sep. 9, 1999

[51] Int. Cl.[7] ..... G05F 3/16

[52] U.S. Cl. ..... 323/316; 323/901

[58] Field of Search ..... 323/313, 314, 323/315, 316, 901; 327/563

[56] References Cited

U.S. PATENT DOCUMENTS

| | | | |
|---|---|---|---|
| 5,521,490 | 5/1996 | Manohar | 323/315 |
| 5,563,504 | 10/1996 | Gilbert et al. | 323/316 |
| 5,619,163 | 4/1997 | Koo | 327/539 |
| 5,821,741 | 10/1998 | Brokaw | 323/311 |
| 5,831,473 | 11/1998 | Ishii | 327/530 |
| 5,874,837 | 2/1999 | Manohar et al. | 326/83 |
| 5,900,772 | 5/1999 | Somerville et al. | 327/539 |
| 5,952,873 | 9/1999 | Rincon-Mora | 327/539 |
| 6,016,050 | 1/2000 | Brokaw | 323/315 |
| 6,031,363 | 2/2000 | Danstrom et al. | 323/273 |

OTHER PUBLICATIONS

LM4040 Precision Micropower Shunt Voltage Reference, National Semiconductor, Sep. 1998, pp. 1–24.

LM7171 Very High Speed, High Output Current, Voltage Feedback Amplifier, National Semiconductor, May 1999, pp. 1–20.

Steffes, M., "Optimizing Performance in An xDSL Line Driver," Electronic Design, Apr. 19, 1999, 12 pages, no page #'s.

Precision Micropower, Low Dropout, Voltage References, REF19x Series, Analog Devices, Inc. 1999, pp. 1–23 no month.

*Primary Examiner*—Shawn Riley

*Attorney, Agent, or Firm*—Blakely, Sokoloff, Taylor & Zafman LLP

[57] ABSTRACT

A method and apparatus for a voltage reference is provided. The circuit may include one or more of the following features: cascode compensation with load balancing to increase the bandwidth of the amplifier for enhanced power supply rejection ratio; PMOS and NMOS in the input stage to expand common mode, having a high gain over voltage range; current mirror using active resistors; and a start-up circuit. The voltage reference comprises an amplifier having an output, the amplifier comprising a first amplifier stage and a second amplifier stage. The amplifier further includes a power-down circuit coupled to the second amplifier stage to float the amplifier output when a power-down signal is active. The voltage reference includes a source follower, the output of the amplifier coupled to the gate of the source follower, and a bandgap circuit for providing a bandgap voltage. The voltage reference further includes a level shifter coupled to the bandgap circuit, the level shifter for providing a second stable operating point, an output of the level shifter or an output of the bandgap circuit being coupled to the first amplifier stage as an input and a current mirror. The voltage reference further comprises a precision resistor for sinking a current generated by the current mirror, the output of the voltage regulator being coupled to one end of the precision resistor.

26 Claims, 4 Drawing Sheets

LOW VOLTAGE REFERENCE WITH POWER SUPPLY REJECTION RATIO

FIELD OF THE INVENTION

The present invention relates to reference voltages, and more specifically, to an improved voltage reference.

BACKGROUND

Voltage references provide a constant output voltage irrespective of changes in input voltage, output current, or temperature. References are needed in such diverse equipment as power supplies, panel meters, calibration standards, data conversion systems, etc.

FIG. 1 illustrates a prior art voltage reference, including an amplifier 120 and a bandgap voltage generator 130. The output of the voltage reference is a stable voltage.

Reference voltage generating circuits are used in integrated circuits. Particularly, in digital mobile apparatuses, in order to reduce the power dissipation, a power saving function is adopted in a reference voltage generating circuit.

Traditionally, Miller compensation has been used for compensating amplifiers used in bandgap implementations. However, this leads to faster gain roll-off due to a single dominant pole and lower power supply rejection. This approach is not adequate for noisy mixed signal environment, where digital spikes on supplies are quite common. In these environments, a fast settling reference with good power supply rejection is needed.

SUMMARY OF THE INVENTION

A voltage reference is described. The voltage reference comprises an amplifier. The voltage reference includes a source follower, the output of the amplifier coupled to the gate of the source follower, and a bandgap circuit for providing a bandgap voltage. The voltage reference further includes a level shifter coupled to the bandgap circuit, the level shifter for providing a second stable operating point, an output of the level shifter or an output of the bandgap circuit being coupled to the first amplifier stage as an input and a current mirror. The voltage reference further comprises a precision resistor for sinking a current generated by the current mirror, the output of the voltage regulator being coupled to one end of the precision resistor.

For one embodiment, one or more of the following features may be included in the voltage reference, to improve power supply rejection ratio (PSRR), increase common mode, improve current source head room, and improve input referenced offset. For one embodiment, the amplifier may include an input stage having both PMOS and NMOS devices. For one embodiment, the amplifier includes cascode compensation and a balancing cascode compensation.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

A voltage reference is described. As systems move to lower power and a higher level of integration, voltage references with enhanced power supply rejection are becoming increasingly useful to implement robust and reliable mixed signal systems. This invention relates to a bandgap reference operational at low voltages with cascode over Miller compensation for better power supply rejection.

For one embodiment, one or more of the following features may be included in the voltage reference, to improve power supply rejection ratio (PSRR), increase common mode, improve current source head room, and minimize input referenced offset. For one embodiment, the amplifier may include an input stage having both PMOS and NMOS devices. For one embodiment, the voltage reference includes a start-up circuit for forcing the voltage reference to a stable operating point. For one embodiment, the amplifier includes cascode compensation and a balancing cascode compensation.

The cascode compensation scheme of the present invention accomplishes this in a variety of ways. The circuit implementation employs an amplifier offering a wider common-mode range using both PMOS and NMOS devices at its input stage for enhanced operation at lower voltages. A start-up circuit is used for reliable operation of the loop, and is incorporated into the bandgap architecture with cascode compensation. Parasitic substrate PNPs are employed for reference voltage generation with a zero temperature coefficient. The circuit implements a control to reduce power in stand-by mode. Dropping reference voltage across an external precision resistor generates a current source for central biasing. The circuit attains improved voltage headroom without using a resistor divider, using ratioed MOS devices to keep the current mirror in saturation. The circuit includes one or more of the following features: cascode compensation with load balancing to increase the bandwidth of the amplifier for enhanced power supply rejection ratio; PMOS and NMOS in the input stage to expand common mode, having a high gain over a larger common mode voltage range; current mirror using active resistors; and a start-up circuit.

Figure 1:
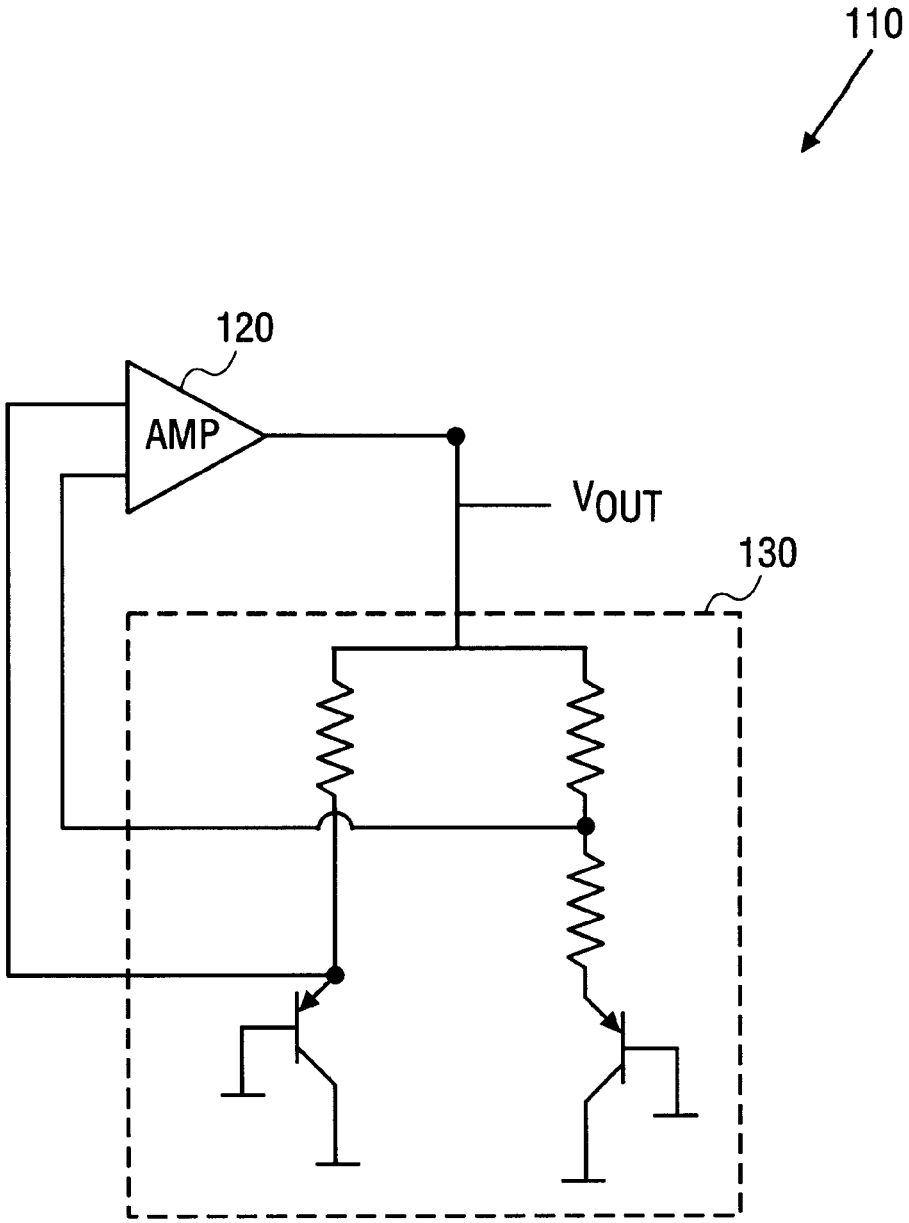
FIG. 1 (PRIOR ART)
FIG. 1 is a prior art voltage reference.
Figure 2:
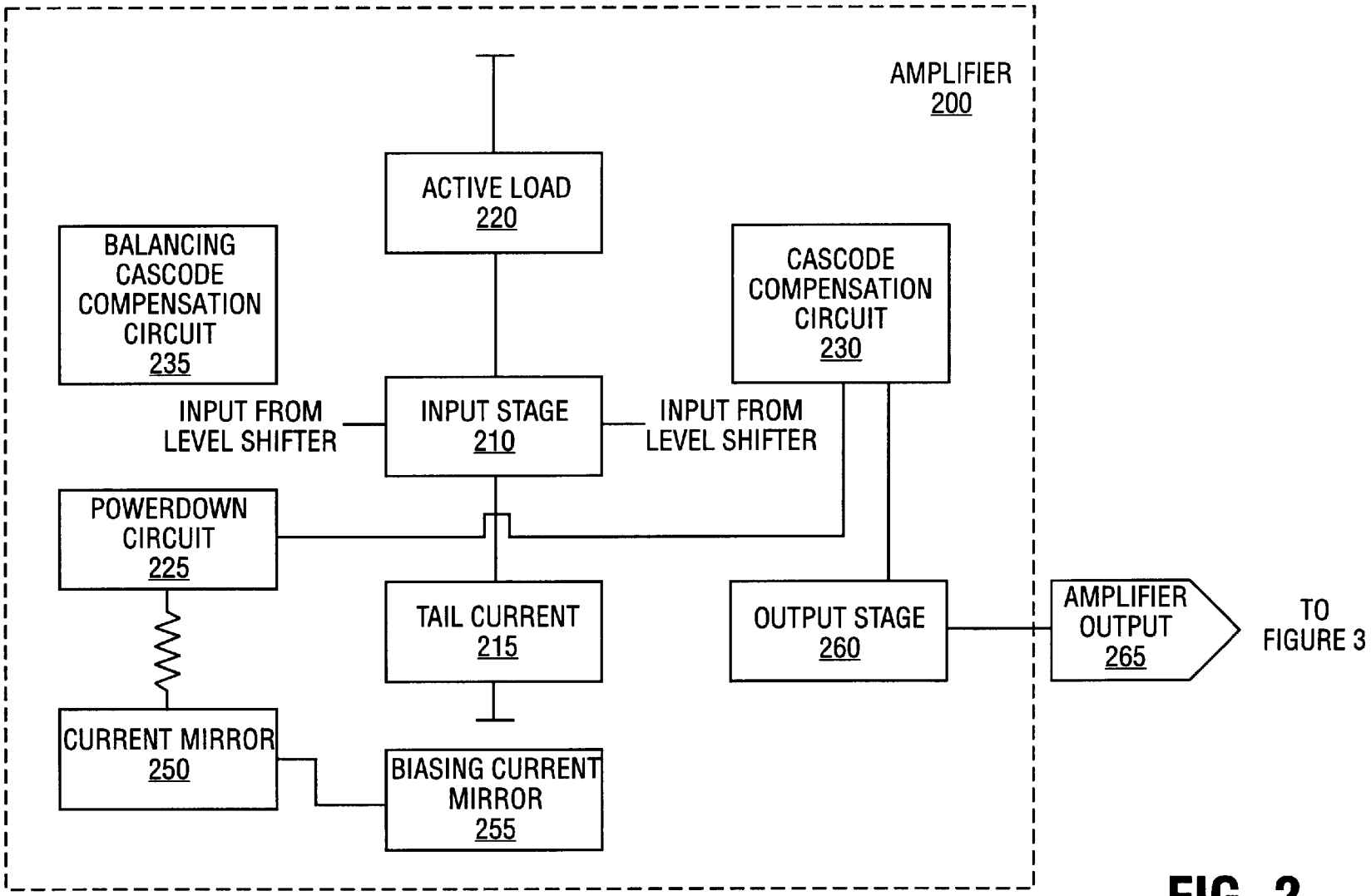
FIG. 2 is a block diagram of one embodiment of the amplifier portion of the voltage reference.

FIG. 2 is a block diagram of the amplifier portion of the voltage regulator. The amplifier 200 includes an input stage 210 having inputs from a bandgap circuit 330 or level shifter 335. For one embodiment, the input stage 210 is an N/P input stage. That is, the input stage 210 includes both N-type metal oxide semiconductors (NMOS) and P-type metal oxide semiconductors (PMOS). For another embodiment, the input stage 210 may include only NMOS or only PMOS.

The input stage 210 is coupled to the active load 220. For one embodiment, the active load 220 comprises two active loads, one coupled to Vcc and one coupled to ground. The input stage 210 is further coupled to tail current generator 215. For one embodiment, tail current generator 215 comprises two tail current generators—one for the NMOS and one for the PMOS—one coupled to ground, the other to Vcc.

A cascode compensation circuit 230 is coupled between the active load 220 and the input stage 210. For one embodiment, the cascode compensation circuit 230 is balanced on the other side by the balancing cascode compensation circuit 235. The sizes of the cascode compensation circuit 230 and balancing cascode compensation circuit 235 are matched, such that the load on either side is balanced. This results in a better offset match. However, if the offset requirement is not important, the balancing cascode compensation 235 may be removed from the circuit.

A powerdown circuit 225 is coupled to the cascode compensation circuit 230 and to a current mirror 250. The powerdown circuit 225 is designed to successfully turn off the amplifier 200 when power is removed from the circuit, dropping the amplifier output 265.

The powerdown circuit 225 is coupled to the current mirror 250 via a resistor. The current mirror 250 generates the current used in the balancing cascode compensation circuit 235.

The output of the cascode compensation circuit 230 is coupled to an output stage 260. The output stage 260 is the second stage of the two stage amplifier 200. The output stage 260 generates the amplifier output 265.

Figure 3:
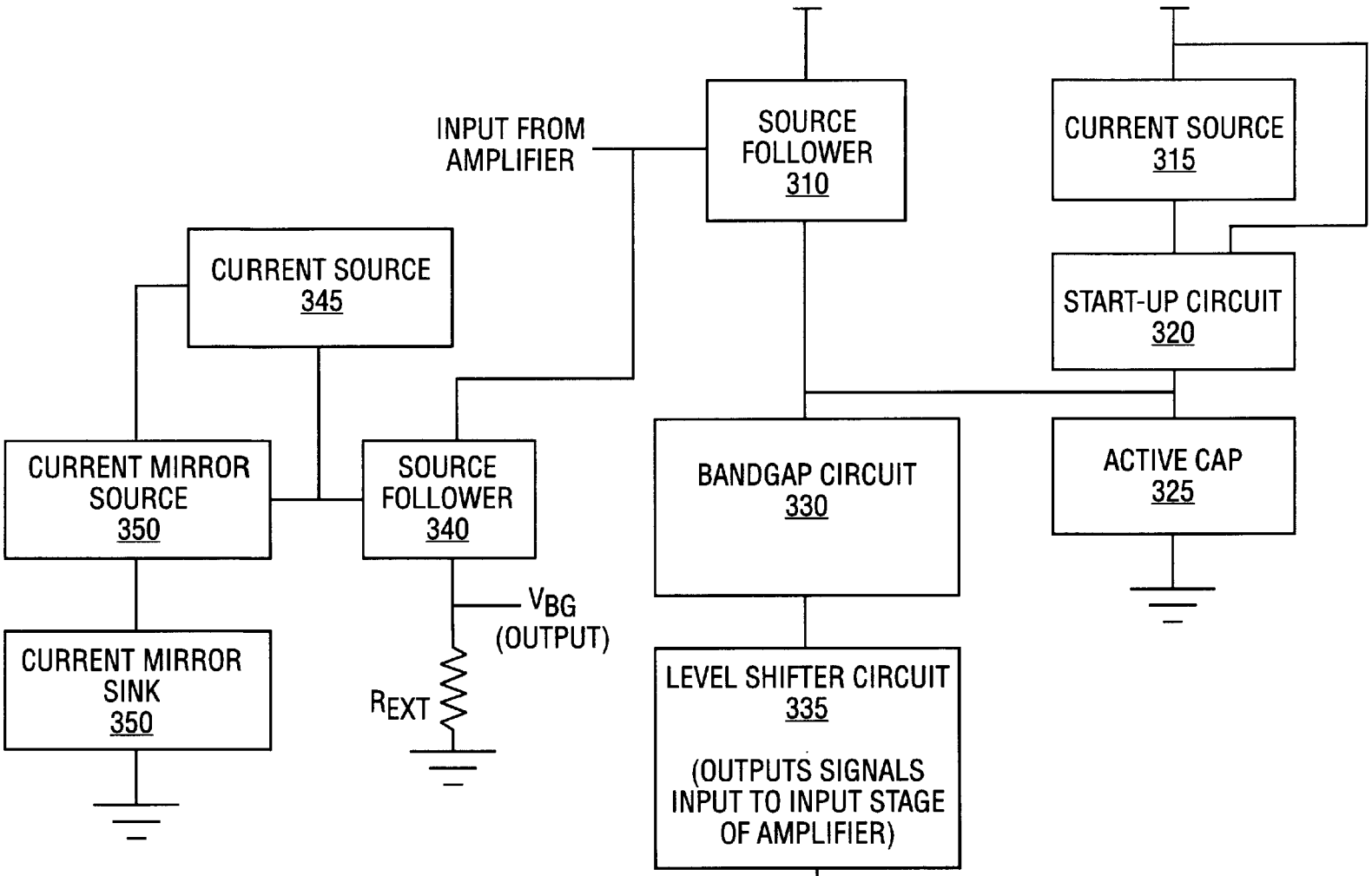
FIG. 3 is a block diagram of one embodiment of the output portion of the voltage reference.

FIG. 3 is a block diagram of the output portion of the voltage regulator. The input from the amplifier (the amplifier output 265) is an input to a source follower 310. The source follower is coupled between Vcc and a bandgap circuit 330.

The bandgap circuit 330 generates the bandgap voltage. For one embodiment, a level shifter circuit 335 is coupled to the bandgap circuit 330. The level shifter circuit generates alternative voltage levels. The outputs of the level shifter circuit 335 are coupled as inputs to the input stage 210 of the amplifier 200. The level shifter 335 permits the voltage reference to have multiple stable operating points.

The source follower 310 is further coupled to an active capacitor 325, which is coupled to ground.

A current source 315 provides a current to the start-up circuit 320. The start-up circuit 320 forces the output to an initial stable point. This keeps the voltage reference from operating at an unstable points.

The input from the amplifier is further coupled to a second source follower 340. The second source follower 340 is matched to the first source follower 310.

A current source 345 is coupled to Vcc, and has an output coupled to a current mirror source 350. The current mirror source 350 and current mirror sink 360 together form a current mirror for the circuit.

An external precision resistor REXT is coupled to the drain of source follower 340. The VBG output of the voltage reference is between the REXT and the source follower 340.

Figure 4:
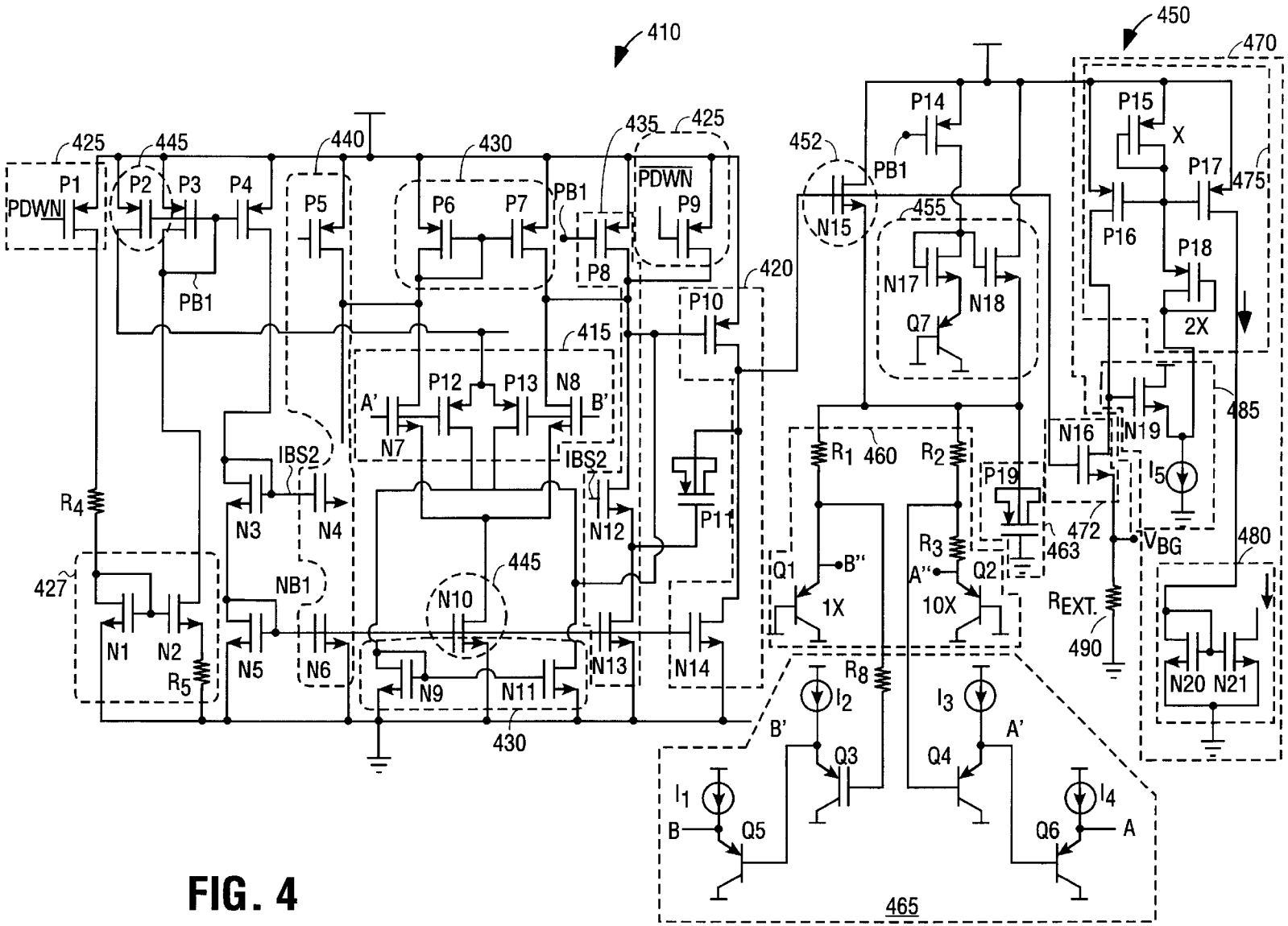
FIG. 4 is a circuit diagram of one embodiment of the voltage reference.

FIG. 4 is a circuit diagram of one embodiment of the voltage regulator. The voltage regulator has two portions, the amplifier 410 and the output portion 450. FIG. 4 is an exemplary implementation of the voltage reference of the current invention. Note that the circuit diagram shown includes numerous details which may be altered. The specific circuitry illustrated may be changed, as is known in the art, to perform the same functions using different circuit elements. It is the interrelationship of the elements that is of interest, not the specific circuit elements used. For example, a P-to-N conversion may be made, as is known in the art, to replace PMOS with NMOS and vice versa. The circuit in FIG. 4 includes all of the elements discussed above with respect to FIGS. 2 and 3.

The amplifier 410 includes a number of sub-circuits. For one embodiment, he amplifier 410 is a two stage amplifier, including an input stage and an output stage.

The input stage 415 includes P-type Metal Oxide Semiconductors (PMOS or P) P12 and P13 and N-type Metal Oxide Semiconductors (NMOS or N), N7 and N8. For one embodiment, the P and N devices are cross-digited, and have a common centroid. For one embodiment, P12, P13, N7 and N8 are all large devices providing larger input capacitances for reduced noise levels. The gate input to N7 and N8 are from bandgap circuit 460 or level shifter 465.

An active load 430 including P6 and P7 are coupled between Vcc and the sources of NMOS N7 and N8 in the input stage 415. The active load 430 is balanced by a second active load 430, including NMOS N9 and N11. N9 and N11 are coupled between the drains of P12 and P13 in the input stage 415 and ground. Both P6 and N9 are diode connected.

The tail current 445 for the PMOS portion of input stage 415 is provided by P2. The tail current 445 for the NMOS portion of the input stage 415 is provided by N10.

The output stage 420 includes P10 and N14. An active capacitor P11 is coupled between P10 and N14 of the output stage. P11 is coupled between the P10 and N14 in the output stage 420 of amplifier 410, and the cascode compensation circuit 435. The output of the output stage 420 is coupled to the gate of source follower N15.

The power-down circuit 425 includes P1, having as a gate input the PWRDN signal, and P9, having as a gate input the PWRDN# signal. For one embodiment, the PWRDN signal is active low. Thus, when the PWRDN signal is activated, i.e. low, Vcc is coupled to P10, and the output is disconnected.

The cascode compensation circuit 435 includes N12, N13, and P8. P8 is coupled to $V_{cc}$, and has as a gate input PB1. N13 is used to pull current from P8, while N12 supplies current for switching. The cascode compensation circuit 435 is balanced on the other side by a dummy compensation circuit 440. The dummy compensation circuit 440 includes P5, N4 and N6. For one embodiment, the dummy compensation circuit 440 may be eliminated. This would cause a higher off-set, but it may be useful in some circuits. Source-coupled NMOS N3 and N5 are coupled to N4 and N6 respectively, to create current mirrors. These current mirrors provide the IBS2 and NB1 current inputs to N4 and N6 respectively.

Current mirror 427 includes N1, N2 and resistor R5. N1 is source coupled to ground. The drain of P1 of the power-down circuit 425 is coupled through resistor R4 to the source and gate of N1, and to the gate of N2. N1 and N2 are ratioed such that the ΔVGS dropped across R5 sets up a Widlar style current mirror. Resistor R4 is a current limiting resistor that controls I, the current. The resistor R5 is coupled between N2 and ground. Resistors R4 and R5 are chosen for the desired current.

The output of amplifier 410 is between P10 and N14 of the output stage 420. The output of amplifier 410 is coupled to the gate of source follower 452.

The source follower 452 is an NMOS N15, coupled between Vcc and bandgap circuit 460. The source follower 452 steps down voltage from the amplifier 410.

Bandgap circuit 460 includes Resistors R1 and R2, as well as bipolar transistors Q1 and Q2. For one embodiment, Q2 is a multiple of Q1. For one embodiment, that multiple is 8×. Resistors R1 and R2 have the same current lowing cross them. The delta $V_{BE}$ is dropped across R3. The output of the bandgap circuit 460, A" and B" may be input to the input stage 415 of the amplifier 410.

Level shifter 465 is coupled to bandgap circuit 460. Level shifter 465 can include multiple levels. In this example, two levels are illustrated. The first level includes 12 and 13, and Q3 and Q4. The second level includes 11 and 14 and Q5 and Q6. For one embodiment Q3–Q6 are matched devices. For one embodiment Q3 and Q4 are matched and have a common centroid layout. For one embodiment, the current sources illustrated I1, I2, I3, and I4 are generated with PMOS devices using bias PB1.

Each level in the level shifter 465 provides an additional stable operating point. The output of the level shifter 465, A or A' and B or B' are input to the input stage 415 of amplifier 410. By selecting which output to connect to the input stage 415, the operating point can be determined. For an alternative embodiment, the level shifter 465 may be excluded from the circuit, and the output of bandgap circuit 460 may be coupled to the inputs of input stage 415. This would result in a lower common mode, but may be useful for a PMOS only input stage 415 implementation.

The source of source follower 452 is also coupled to P19. P19 is coupled between source follower 452 and ground as an active capacitor. P19 acts as load compensation bandgap capacitor.

A start-up circuit 455 forces the circuit to a non-zero state, assuring a stable operating point. The start-up circuit 455 includes, N17, N18, and Q7. The start-up circuit 455 forces $V_{BE}$ at the source of N15.

Current source P14 has as a gate input current PB1, and is coupled between Vcc and the start-up circuit 455. The current source P14 provides the current for the start-up circuit 455.

The output of amplifier 410 is also coupled to the gate of a second source follower N16. For one embodiment, the second source follower, N16, is matched to the first source follower, N15. The source of the second source follower 472 is coupled to Vcc via P16.

The current mirror 470 includes a current source 475 and a current sink 480, and 485.

The 485 includes N19 and current source I5.

The current source 475 includes P15, P16, P17, and P18. P15 and P18 are drain coupled, and are multiples of each other. For one embodiment, the relative sizes (W/L) of P15 and P18 relate as X:2×. P15, P16, and P17 have their sources coupled to Vcc, while the drain of P16 is coupled to source follower N16, the drain of P17 is coupled to current sink 480, and the drain of P15 is coupled to the gates of P16 and P17, and to the source of P18. The drain of P18 is coupled to the 485. The current flowing between the drain of P17 and current sink 480 is the mirrored current.

The current sink 480 includes N20 and N21, where N20 is source-coupled, and N20 and N21 have as gate inputs the current of current source 475. The source current to N21 is the current $I_{CM}$. The sources of N20 and N21 are coupled to ground, thus providing a current sink 480.

The drain of source follower 472 is coupled to ground via resistor $R_{EXT}$.

The resistor $R_{EXT}$, a resistor external to the voltage regulator, is a precision resistor, and sets precision currents internally. The current $I_{CM}$ is across $R_{EXT}$, and is coupled to the source of N21, in the current sink. The output of the voltage regulator, $V_{BG}$, is between source follower 472 and $R_{EXT}$.

For one embodiment, various substitutions may be made for any of the above-described elements. However, generally the relationships between the elements remain as discussed above. For example, a current mirror 470 having a different structure may be used instead of the current mirror specifically described. For example, for one embodiment, a single stage amplifier 410 may be used. For another embodiment, a simple P-type or simple N-type input stage 415 may be used for the amplifier 410. For another embodiment, the current mirror may be eliminated or substituted by a current mirror having different structure. Similarly, each of the recited elements may be substituted by a differently implemented element to perform the same function. For example, current mirror 470 may be implemented differently.

For one embodiment, certain elements, such as the dummy cascode compensation circuit, the powerdown circuit, and the level shifter, may be eliminated completely in some implementations. For another embodiment, a P-to-N conversion may be performed on the circuit. These types of variations are understood by those in the art.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A voltage regulator comprising:

a balanced amplifier;

an emitter follower coupled to the output of the amplifier;

a current mirror; and a start-up circuit for forcing a pole comprising:

a bipolar transistor;

a first NMOS coupled between a current source and the bipolar transistor, the gate of the first NMOS coupled to its source;

a second NMOS coupled between Vcc and an active capacitor to ground, the gate of the second NMOS coupled to the gate of the first NMOS;

wherein the start-up circuit forces the voltage regulator to a stable operating point.

2. The voltage regulator of claim 1, wherein the balanced amplifier comprises:

an input stage;

a cascode compensation circuit;

a balancing cascode compensation circuit; and a current mirror.

3. The voltage regulator of claim 2, wherein the input stage comprises an N-type metal oxide semiconductor (NMOS) and a P-type metal oxide semiconductor (PMOS) portions.

4. The voltage regulator of claim 3, wherein the NMOS and the PMOS portions of the input stage are cross-digited and have a common centroid.

5. The voltage regulator of claim 2, further comprising a power-down circuit.

6. The voltage regulator of claim 2, further comprising:

a bandgap circuit for creating a bandgap voltage; and a level shifter circuit for providing additional stable points of operation, the output of the level shifter circuit coupled as inputs to the input stage.

7. The voltage regulator of claim 6, wherein the level shifter comprises:

a first bipolar transistor pair coupled between a current source and ground; and a second bipolar transistor pair coupled between a current source and ground, such that the gate voltage of the first bipolar transistor pair is coupled to the source of the second bipolar transistor pair;

wherein the first bipolar transistor pair and the second bipolar transistor pair are matched devices having a common centroid layout.

8. The voltage regulator of claim 1, wherein the current mirror comprises a second source follower coupled to the output of the balanced amplifier, and a mirror comprising:

a current source comprising:

a first P-type metal oxide semiconductor (PMOS) having its source coupled to Vcc, and its drain coupled to the source of the second source follower;

a second PMOS having its source coupled to Vcc and its drain coupled to a current sink;

a third drain-coupled PMOS coupled to Vcc;

a fourth drain coupled PMOS, the fourth PMOS being a multiple of the third PMOS;

the gates of the first PMOS and the second PMOS coupled together and to the source of the fourth PMOS and the drain of the third PMOS;

the current sink comprising:

a source-coupled first N-type metal oxide semiconductor (NMOS) and a second NMOS, the gates of the first and the second NMOS coupled together, the drain of the second PMOS coupled to the source of the first NMOS, and the drains of the first and second NMOS coupled to ground.

9. The voltage regulator of claim 2, wherein the balancing cascode compensation circuit comprises a PMOS, and NMOS and a second NMOS coupled in series between Vcc and ground; and wherein the first NMOS and the second NMOS are coupled to a third and a fourth NMOS as current mirrors to generate an input current to the balancing cascode compensation circuit.

10. A voltage reference having a stable output voltage, the voltage reference including:

an amplifier; and a bandgap voltage generator comprising:

a first resistor coupled to a source of a first multiple bipolar transistor, the gate and drain of the first multiple bipolar transistor being coupled to ground; and a second resistor coupled in series with a third resistor, the third resistor coupled to the source of a second multiple bipolar transistor, the gate and drain of the second multiple bipolar transistor coupled to ground;

wherein the band gap voltage is determined by a ratio of the first multiple and the second multiple.

11. The voltage reference of claim 10, further comprising a level shifter comprising:

a first circuit comprising:

a current source;

a first bipolar transistor having the current source coupled as a source, and having ground coupled to its drain;

a second circuit, the second circuit comprising:

a current source;

a second bipolar transistor having the current source coupled as a source, and having ground coupled to its drain, the gate of the first bipolar transistor coupled to the source of the second bipolar transistor, the drain of the second bipolar transistor being coupled through a fourth resistor to the source of the first multiple bipolar transistor;

a third circuit comprising:

a current source;

a third bipolar transistor having the current source coupled as a source, and having ground coupled to its drain;

a fourth circuit, the fourth circuit comprising:

a current source;

a fourth bipolar transistor having the current source coupled as a source, and having ground coupled to its drain, the gate of the third bipolar transistor coupled to the source of the fourth bipolar transistor, the drain of the fourth bipolar transistor being coupled between the second resistor and the third resistor.

12. The voltage reference of claim 10, further comprising a start-up circuit for forcing the voltage reference to a stable operating pole, the startup circuit comprising:

a first source coupled N-type metal oxide semiconductor (NMOS);

a first bipolar transistor having its gate and its drain coupled to ground, the source of the bipolar transistor coupled to the drain of the first NMOS; and a second NMOS coupled between voltage supply $V_{cc}$ and a P-type metal oxide semiconductor (PMOS) acting as a load compensation bandgap capacitor;

such that the startup circuit forces $V_{BE}$ on the gate of the PMOS.

13. The voltage reference of claim 10, wherein an output of the amplifier is coupled to a source follower, and the drain of the source follower is coupled to the bandgap voltage generator.

14. The voltage reference of claim 10, wherein amplifier comprises:

an input stage;

an output stage; and a cascode compensation circuit.

15. The voltage reference of claim 14, wherein the amplifier further comprises a balancing cascode compensation circuit to balance the load of the cascode compensation circuit.

16. The voltage reference of claim 14, wherein the input stage comprises:

a pair of P-type metal oxide semiconductors (PMOS) having their gates coupled to an input from the bandgap voltage generator, their sources coupled to a tail current provider, and having their drains coupled to an active load.

17. The voltage reference of claim 16, wherein the input stage further comprises:

a pair of N-type metal oxide semiconductors (NMOS) having their gates coupled to the input from the bandgap voltage generator, having their sources coupled to an active load, and having their drains coupled to a tail current provider.

18. The voltage reference of claim 17, wherein the pair of PMOS and the pair of NMOS are matched devices having a common centroid.

19. The voltage reference of claim 14, further comprising a powerdown circuit, such that when a power-down signal is sent to the voltage reference, no signal is output from the amplifier.

20. A voltage regulator comprising:

an amplifier having an output, the amplifier comprising:

a first amplifier stage;

a second amplifier stage;

a power-down circuit coupled to the second amplifier stage to float the amplifier output when a power-down signal is active;

a source follower, the output of the amplifier coupled to the gate of the source follower;

a bandgap circuit for providing a bandgap voltage;

a level shifter coupled to the bandgap circuit, the level shifter for providing a second stable operating point, an output of the level shifter or an output of the bandgap circuit being coupled to the first amplifier stage as an input;

a current mirror; and a precision resistor for sinking a current generated by the current mirror, the output of the voltage regulator being coupled to one end of the precision resistor.

21. The voltage regulator of claim 20, wherein the amplifier further comprises a cascode compensation circuit and a balancing cascode compensation circuit.

22. The voltage regulator of claim 20, further comprising a start-up circuit for forcing the voltage regulator to a stable operating pole, the startup circuit comprising:

a first source coupled N-type metal oxide semiconductor (NMOS);

a first bipolar transistor having its gate and its drain coupled to ground, the source of the bipolar transistor coupled to the drain of the first NMOS; and a second NMOS coupled between voltage supply $V_{CC}$ and a P-type metal oxide semiconductor (PMOS) acting as a load compensation bandgap capacitor;

such that the startup circuit forces $V_{BE}$ on the gate of the PMOS.

23. The voltage regulator of claim 20, wherein the first amplifier stage is an input stage with both N-type metal oxide semiconductors and P-type metal oxide semiconductors.

24. The voltage regulator of claim 23, wherein the input stage comprises:

a pair of P-type metal oxide semiconductors (PMOS) having their gates coupled to an input from the bandgap voltage generator, their sources coupled to a tail current provider, and having their drains coupled to an active load; and a pair of N-type metal oxide semiconductors (NMOS) having their gates coupled to the input from the band gap voltage generator, having their sources coupled to an active load, and having their drains coupled to a tail current provider;

wherein the pair of PMOS and the pair of NMOS are matched devices having a common centroid.

25. A voltage regulator comprising:

an amplifier;

a source follower having as gate input the output of the amplifier;

a bandgap circuit for generating a bandgap voltage;

a start-up circuit comprising:

a gate coupled NMOS having its source coupled to a parasitic substrate PNP device;

a second NMOS coupled between Vcc and a capacitor, the gate of the second NMOS coupled to the source of the gate coupled NMOS;

the startup circuit for forcing the bandgap circuit to a stable initial point, when the voltage regulator is first turned on, by charging the capacitor, which is coupled to the bandgap circuit; and a current mirror.

26. A voltage regulator comprising:

an amplifier comprising:

a first stage of the amplifier, comprising:

two cross-digited pairs of NMOS and PMOS;

an active load coupled between a source of both the NMOSes of the cross digited pairs and a voltage supply;

a tail current NMOS coupled between drains of both the NMOSes and ground;

a tail current PMOS coupled between a source of both the PMOSes of the cross-digited pairs and the voltage supply;

an active load coupled between drains of both the PMOSes and ground;

a cascode compensation circuit comprising:

a PMOS and two NMOS coupled in series between the voltage supply and the ground a second stage of the amplifier comprising:

a PMOS and an NMOS coupled in series between the voltage supply and the ground, the an output of the amplifier coupled between the PMOS and the NMOS of the second state of the amplifier.

* * * * *

UNITED STATES PATENT AND TRADEMARK OFFICE

CERTIFICATE OF CORRECTION

PATENT NO. :6,118,266

DATED : September 12, 2000

INVENTOR(S) : Amar S. Manohar, Bor Lee, and Vincent Condito

It is certified that error appears in the above-identified patent and that said Letters Patent is hereby corrected as shown below:

In the Title Page at [54] before the word "Power", insert --Improved--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*